US009909807B2

(12) United States Patent
Chen et al.

(10) Patent No.: US 9,909,807 B2
(45) Date of Patent: Mar. 6, 2018

(54) DRYERS FOR REMOVING SOLVENT FROM A DRUG-ELUTING COATING APPLIED TO MEDICAL DEVICES

(75) Inventors: Yung-Ming Chen, San Jose, CA (US); Matthew J. Gillick, Murrieta, CA (US); Michael T. Martins, Murrieta, CA (US); John E. Papp, Temecula, CA (US)

(73) Assignee: ABBOTT CARDIOVASCULAR SYSTEMS INC., Santa Clara, CA (US)

( * ) Notice: Subject to any disclaimer, the term of this patent is extended or adjusted under 35 U.S.C. 154(b) by 291 days.

(21) Appl. No.: 13/235,238

(22) Filed: Sep. 16, 2011

(65) Prior Publication Data

US 2013/0071549 A1 Mar. 21, 2013

(51) Int. Cl.
*F26B 25/06* (2006.01)
*F26B 9/00* (2006.01)

(52) U.S. Cl.
CPC ..... *F26B 25/066* (2013.01); *F26B 9/003* (2013.01)

(58) Field of Classification Search
CPC . A61L 33/00; A61L 2/00; B05C 13/02; B05C 5/02; B05D 1/40; B05D 1/36; B05D 1/02; B05D 3/00; F26B 25/06; F26B 3/02; A45D 1/00; A61F 2/06
USPC ..... 132/9; 34/99, 210, 443, 96, 282; 427/2.25, 2.24, 421, 402, 212, 215, 242, 427/555, 425; 118/620, 500, 503, 320; 623/1.39
See application file for complete search history.

(56) References Cited

U.S. PATENT DOCUMENTS

| | | | | |
|---|---|---|---|---|
| 3,023,515 | A * | 3/1962 | Stern | 34/99 |
| 3,814,111 | A * | 6/1974 | Doyle et al. | 132/272 |
| 4,085,522 | A | 4/1978 | Stroszynski | |
| 4,733,665 | A | 3/1988 | Palmaz | |
| 4,800,882 | A | 1/1989 | Gianturco | |
| 4,886,062 | A | 12/1989 | Wiktor | |
| 5,507,768 | A | 4/1996 | Lau et al. | |

(Continued)

FOREIGN PATENT DOCUMENTS

| | | |
|---|---|---|
| EP | 0 438 235 | 7/1991 |
| FR | 1 238 899 | 8/1960 |

(Continued)

OTHER PUBLICATIONS

International Search Report for PCT/US2012/050803, dated Nov. 28, 2012, 6 pgs.

(Continued)

*Primary Examiner* — Dah-Wei D Yuan
*Assistant Examiner* — Andrew Bowman
(74) *Attorney, Agent, or Firm* — Squire Patton Boggs (US) LLP

(57) ABSTRACT

A coating device for coating a medical device with a drug-eluting material uses an in-process drying station between coats to improve a drug release profile. The drying station includes a dryer having a telescoping plenum which provides a shield and drying region for the stent or scaffold to reside while a heated gas is passed over the stent/scaffold. The shield and drying region improve efficiency in drying, predictability or drug release rate, uniformity of coating material properties lengthwise over the stent/scaffold and provide a platform that can effectively support stents that are over 40 mm in length.

18 Claims, 9 Drawing Sheets

(56) References Cited

U.S. PATENT DOCUMENTS

| | | | | |
|---|---|---|---|---|
| 5,514,154 | A | 5/1996 | Lau et al. | |
| 5,569,295 | A | 10/1996 | Lam | |
| 5,906,862 | A | 5/1999 | Yapel et al. | |
| 6,018,886 | A | 2/2000 | Bell et al. | |
| 7,211,150 | B1 * | 5/2007 | Kokish et al. | 118/500 |
| 7,340,846 | B1 | 3/2008 | Jou | |
| 7,572,336 | B2 | 8/2009 | Van Sciver et al. | |
| 2003/0099765 | A1 * | 5/2003 | Jayaraman | 427/2.24 |
| 2003/0115709 | A1 | 6/2003 | Haruch et al. | |
| 2003/0215564 | A1 * | 11/2003 | Heller et al. | 427/2.25 |
| 2003/0226276 | A1 | 12/2003 | Yonkoski et al. | |
| 2007/0154512 | A1 | 7/2007 | Dave et al. | |
| 2007/0275175 | A1 * | 11/2007 | Hossainy | B05B 13/0235 427/425 |
| 2008/0307668 | A1 * | 12/2008 | Watterodt et al. | 34/282 |
| 2008/0311280 | A1 | 12/2008 | Chen et al. | |
| 2009/0035449 | A1 | 2/2009 | Chen et al. | |
| 2010/0070026 | A1 * | 3/2010 | Ito | A61F 2/07 623/1.39 |
| 2010/0275459 | A1 | 11/2010 | Wentworth et al. | |
| 2011/0000427 | A1 | 1/2011 | Bobson et al. | |
| 2011/0039013 | A1 | 2/2011 | Papp et al. | |
| 2011/0059227 | A1 | 3/2011 | Pacetti et al. | |
| 2011/0059228 | A1 * | 3/2011 | Gillick et al. | 427/2.25 |

FOREIGN PATENT DOCUMENTS

| | | |
|---|---|---|
| GB | 1 024 671 | 3/1966 |
| GB | 2 384 295 | 7/2003 |

OTHER PUBLICATIONS

International Search Report for PCT/US2010/040959, dated Apr. 3, 2011, 3 pgs.

International Search Report for PCT/US2010/046851, dated May 16, 2011, 5 pgs.

Digital Mass Flow Controllers, product information, bulletin EM200803 DFC, downloaded from www.aalborg.com, 7 pgs. no date available.

IVEK Precision Liquid Dispensing, Metering & Ceramic Pumps, Product Information, IVEK Corp. 1 pg. (2008).

Sylvania air heaters, product information 22 pgs (2005).

* cited by examiner

DRYERS FOR REMOVING SOLVENT FROM A DRUG-ELUTING COATING APPLIED TO MEDICAL DEVICES

BACKGROUND OF THE INVENTION

Field of the Invention

The present invention relates to drug-eluting medical devices; more particularly, this invention relates to processes for controlling the interaction among polymer, drug and solvent, and the release rate of a drug for drug eluting medical devices.

Background of the Invention

Strict pharmacological and good mechanical integrity of a drug eluting medical device are required to assure a controlled drug release. Significant technical challenges exist when developing an effective and versatile coating for a drug eluting medical device, such as a stent.

A coating may be applied by a spray coating process. A drug-polymer composition dissolved in a solvent is applied to the surface of a medical device using this method. The amount of drug-polymer to be applied has been expressed as a target coating weight, which corresponds to the weight of the coating after a substantial amount of the solvent is removed.

Previous efforts to produce a more consistent and stable drug release profile have been met with challenges. Prior efforts have focused on the type or structure of the polymer carrier for a drug, and the type of solvent used. However, these improvements have not been able to satisfactorily meet the needs for certain clinical applications, or provide a morphology that can be widely used.

A "drug release profile", or "release profile" means the morphology, or characteristics of a drug-eluting matrix that delivers an expected therapeutic behavior after being placed within a body. A drug release profile, or release profile therefore informs one of such things as the predictability of the release rate, variation, if any, in the release rate over time or on a per unit area basis across a drug-eluting surface.

It has been previously discovered that a significant improvement in the ability to tailor a drug release profile to suit a particular objective such as producing a specific release rate, uniformity in the release rate over a drug eluting surface, and/or uniformity in a production setting (high throughput) lay in obtaining more precise control over the amount of solvent present, or rate of solvent removal. The criticality of solvent removal, distribution, etc. generally depends on the drug-polymer-solvent formulation and particular objectives. While it was already known that the morphology of a drug-polymer matrix is influenced by the presence of a solvent, it was later discovered that this interaction played a more significant role than previously thought. Based on this conclusion, a more effective process for controlling the amount of solvent-polymer-drug interaction was sought. It was found that the coating weight per spray cycle and manner in which solvent was removed, in connection with the coating thickness was an important consideration.

A relatively high coating weight per spray cycle has been sought in the past, because this minimizes process time and increases throughput. Maintaining control over the amount or rate of solvent removal is, however, challenging unless an applied coating layer is relatively thin. If the applied layer is too thick the removal of the solvent becomes more difficult to control or predict. When the solvent is removed from a thick layer, therefore, the potential for undesired interaction among the solvent, polymer and drug, and related problems begin to impair the ability to retain control over the release profile.

Process conditions can affect the desired morphology. For example, if there is excess residual solvent, i.e., solvent not removed between or after a spray cycle, the solvent can induce a plasticizing effect, which can significantly alter the release rate. Therefore, it can be critically important to have a process that produces a coating with consistent properties—crystallinity, % solvent residue, % moisture content, etc. If one or more of these parameters are not properly controlled, such that it varies over the thickness or across a surface of a drug-eluting device, then the release profile is affected. One or more of these considerations can be more critical for some drug-polymer-solvent formulations than for other formulations.

To facilitate the incorporation of a drug on a stent, spraying a low solid percent polymer/drug solution over the stent followed by removing the solvent has become feasible in controlling the amount of drug (in micrograms range) deposited on the stent and the release profile. A good coating quality benefits from using this spray technique, i.e., properties such as the crystallinity, % solvent residue, and % moisture content are more controllable as the coating weight is built up over several applied coatings.

Previous studies of the drying effect on drug release indicated a need for an optimal in-process or inter-pass drying technique to remove a solvent on the coated stent after each spray cycle. This is a critical step in producing more stable products while retaining a high throughput.

The properties of a solvent, e.g., surface tension, vapor pressure or boiling point, viscosity, and dielectric constant, used in dissolving a polymer have a dominant effect on the coating quality, coating process throughput, drug stability, and the equipment required to process it. A solvent can, of course, be removed by applying a heated gas over the stent. However, this drying step must be carefully controlled in order to achieve the desired end result. A uniform and efficient heat transfer from the gas to the coating surface must also take place.

The evaporation rate of a suitable solvent has an inverse relationship with the coating thickness (generally inversely proportional to the thickness) for a thin film coating. And the resistance increases non-linearly as the coating thickness increases. As alluded to earlier, this non-linearity should be avoided. When the coating thickness is not too high more uniformity and control can be achieved in removing the solvent. As a result, a more consistent drug release profile is obtained because there is the least drug-solvent-polymer interaction, solvent plasticizing and drug extraction rate. It is therefore desired to achieve more control over, not only the uniformity of properties across the coating thickness and along the length of the stent, but also the ability to remove solvent. This is because residual solvent on the drug eluting stent may induce adverse biological responses, compromise coating properties, induce drug degradation, and alter release profile.

Thus, it has been determined that a release rate can be better controlled by applying many coats of a low percentage solution, e.g., 5% of the final coating weight, with a drying step between each spray cycle. Thus, in this example 20 coats are needed to produce the target coating weight. In order to make this coating process more feasible as a production-level method, while maintaining control over the solvent and solvent-drug-polymer interaction, as just discussed, an efficient in-process drying step is needed.

Effective ways to remove residual solvent in the applied coating becomes more important for coating formulations that are more sensitive to a residual solvent level. As explained above, excessive remaining solvent impacts the coating morphology and property. For example, in the case of a coating formulation used for a polymer scaffold, e.g., PLLA, residual solvent left in the coating can induce phase separation between the drug and polymer because the drug and polymer are not miscible. This can cause variation of the drug release rate and adversely impact the physical properties of the coating. It is therefore desirable to achieve an optimized in-process dry nozzle design to ensure the removal of most of the residual solvent between successive spray cycles. Examples of dryers seeking to achieve this objective are described in US20110059228 and US20110000427.

For example, US20110000427 proposes using an external heat nozzle design having a narrow opening producing a drying gas exiting from the dryer plenum at relatively high velocity. This arrangement requires precise alignment between the stent and heat nozzle for uniform drying. The design can introduce extensive and interfering mixing of outside air into the gas stream before contacting the stent or scaffold; this mixing of outside air is uncontrolled and causes variation in the temperature across the drying area. Additionally, the high velocity gas causes the stent to oscillate, which can be problematic for longer-length stents, such as those intended for peripheral vessels.

There is a continuing need for obtaining a better control over the drug-eluting product. Specifically, there is a need to develop an inter-pass drying process that is better able to remove solvent to achieve improved rate of release of a drug, uniformity of release rate over the stent length and/or the effectiveness of a drug when released from the coating. It is also desirable to reduce processing time when applying a drug-eluting coating.

SUMMARY OF THE INVENTION

The invention proposes an in-process dryer for maximizing in-process drying efficiency and uniformity for improving the product quality (e.g. coating and its drug release consistency). A dryer and associated process according to the invention can also obviate the need for an oven step which has been relied on to remove residual solvent, thereby streamlining the manufacturing process.

A dryer nozzle according to the invention has a wider mouth or exit from the plenum than previously proposed stent dryer designs. With this design mean gas velocity at the dryer nozzle is reduced over earlier dryer designs, so that there is less or no influence by the surrounding ambient air and less oscillations of the stent during drying. In a preferred embodiment the dryer is constructed as a telescoping dryer assembly, although other designs are contemplated, e.g., a dryer nozzle that is moved into and out of position as a single unit connected to a flexible gas supply. A shield surrounds the drying region to isolate heated gas from surrounding cooler ambient air. The stent (or scaffold) is disposed within this drying region during the drying step. The dryer nozzle is retractable, which allows clearance for movement of the sent or scaffold between spraying and drying stations. The feature of a retractable dryer nozzle also simplifies drying operations, such as concerns aligning the stent with the mouth or exit.

A dryer according to the invention addresses alignment issues and uneven drying seen in prior designs by ensuring full coverage and uniform heat application. In addition, the influence of ambient air in the drying operation is effectively minimized or eliminated. Tests have shown that the temperature within the shielded area of the drying region and just above it is at a constant temperature, indicating that no ambient air is drawn into the drying region. Since the hot air within the drying region is at a slightly higher pressure than the surrounding ambient air, ambient air is prevented from being drawn into the drying region. The dryer nozzle includes internal diffusers, e.g., stacked spacer and screen assemblies, to uniformly mix the heated drying gas, resulting in a temperature uniformity of within 1 degree C. across the stent drying area.

Accordingly, an inter-pass dryer, according to the invention, that is used in a stent coating process improves on the art by providing an apparatus and method for forming a drug-eluting coating that offers greater control over the release rate for a drug and less undesired interaction between residual solvent and the drug-polymer matrix in the coating. The term "inter-pass drying" means drying, or removing solvent between one, two, three or more spray passes. The weight of material per coat is in some embodiments are very light, about 5% of the total coating weight according to one embodiment. This means, for this particular embodiment, 20 coats are needed to reach 100% of the coating weight.

In view of the foregoing, the invention provides one or more of the following additional improvements over the art.

According to one aspect of invention, a method for applying a composition to a stent, comprising the steps of spraying the composition on the stent; and drying the stent, including the steps of moving a shield, surrounding a drying region, over the stent, applying a drying gas to dry the stent, and after drying the stent, moving the shield away from the stent.

According to another aspect of invention, a dryer nozzle for drying a stent includes a first housing configured for being connected to a gas supply; a second housing movable within the first housing, the second housing including a drying region in fluid communication with a mouth of the dryer nozzle and configured to receive and support a mandrel, the mouth being located at a base of the drying region, and a diffusion chamber disposed below the mouth.

According to another aspect of invention, a stent coating system includes a sprayer; a telescoping dryer nozzle; and a linear actuator for moving a stent-supporting mandrel between the telescoping dryer nozzle and the sprayer. The system may further include a rotary actuator for rotating the stent-supporting mandrel to improve consistency and uniformity of solvent removal.

INCORPORATION BY REFERENCE

All publications and patent applications mentioned in the present specification are herein incorporated by reference to the same extent as if each individual publication or patent application was specifically and individually indicated to be incorporated by reference. To the extent there are any inconsistent usages of words and/or phrases between an incorporated publication or patent and the present specification, these words and/or phrases will have a meaning that is consistent with the manner in which they are used in the present specification.

DETAILED DESCRIPTION OF EMBODIMENTS

According to a preferred implementation of the invention, a sprayer and dryer nozzle is used to form a drug-eluting coat on a surface of a stent. A stent is an intravascular prosthesis that is delivered and implanted within a patient's vasculature or other bodily cavities and lumens by a balloon catheter for balloon expandable stents and by a catheter with an outer stent restraining sheath for self expanding stents. The structure of a stent is typically composed of scaffolding, substrate, or base material that includes a pattern or network of interconnecting structural elements often referred to in the art as struts or bar arms. A stent typically has a plurality of cylindrical elements having a radial stiffness and struts connecting the cylindrical elements. Lengthwise the stent is supported mostly by only the flexural rigidity of slender-beam-like linking elements, which give the stent longitudinal flexibility. Examples of the structure and surface topology of medical devices such as a stent and catheter are disclosed by U.S. Pat. Nos. 4,733,665, 4,800,882, 4,886,062, 5,514,154, 5,569,295, and 5,507,768.

As discussed earlier, one aspect of the stent coating process that has been simplified, or improved, as a result of the dryer according to the disclosure, is the ability to predict more consistently the rate of solvent removal and variation of that rate over the length of the stent. Increasing the predictability of a solvent's presence in the applied coating, or remaining when determining a final weight can greatly increase the ability and/or efficiency in which a predictable release rate for a drug can be provided in a medical device, in the form of an applied coating.

Moreover, as the design or desired loading of polymer-drug on the stent is determined from the measured weight, it will be readily appreciated that there needs to be an accurate, reliable and repeatable process for being able to determine the amount and distribution of solvent remaining over the length of the stent. This is especially true when less volatile solvents are used, e.g., DMAc as opposed to the more volatile solvent Acetone. Since it is expected that a greater percentage of solvent will remain after drying for solvents having higher boiling points, the coating is more susceptible to variations in a solvent's presence over the stent surface and/or across the coating thickness. Also when drying a polymer Acetone mixture, the rate and uniformity of drying affects the % crystallinity and thus the amount of locked in residual solvent.

The disclosure provides examples of spraying/drying components suited for addressing the previously discussed drawbacks and limitations in the art pertaining to a drug-eluting coating applied via a drug-polymer dissolved in a solvent.

Figure 1A:
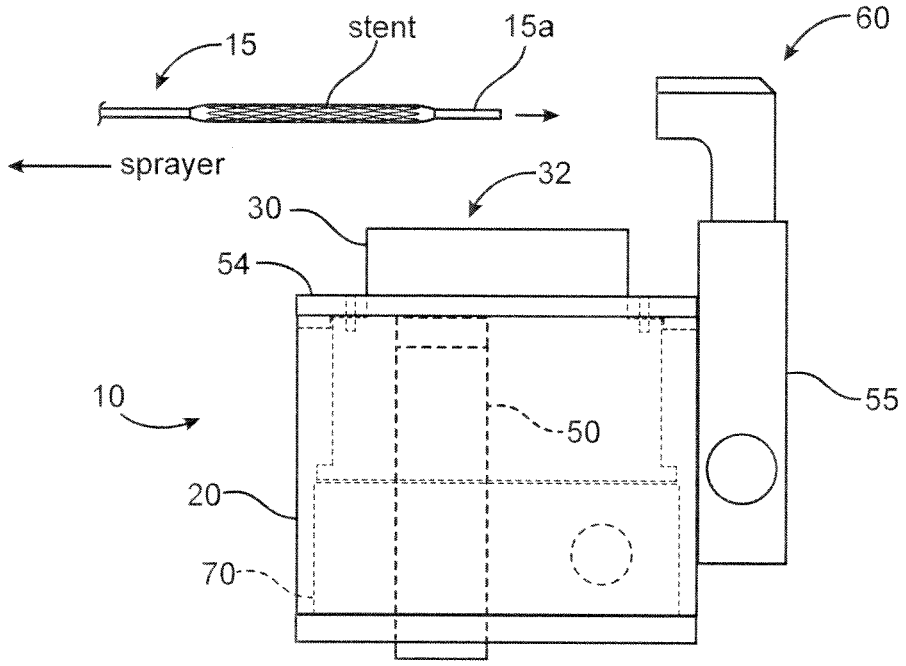
FIG. 1A is side view of a dryer assembly in a first, retracted position according to one aspect of the disclosure.
Figure 1B:
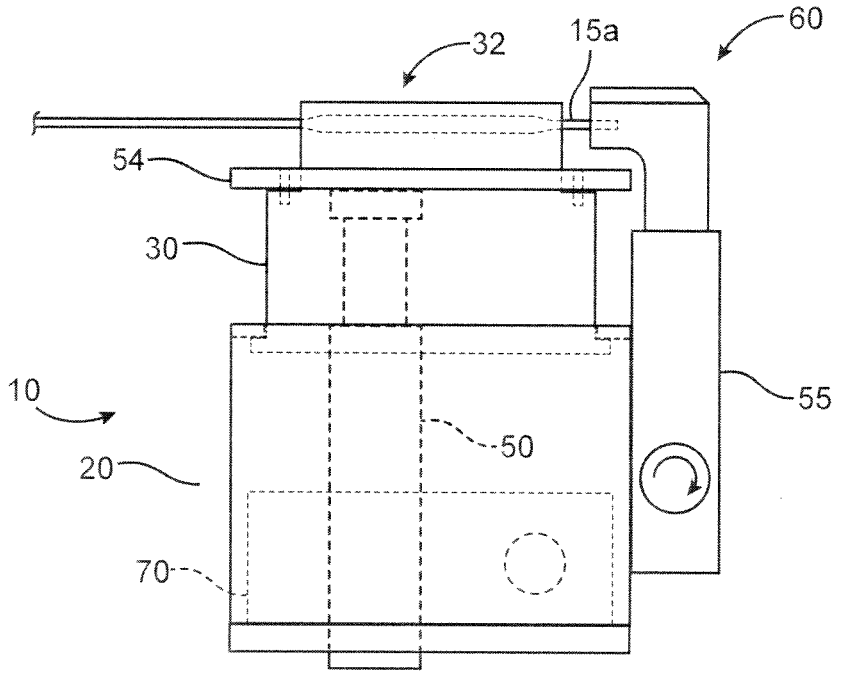
FIG. 1B is side view of the dryer assembly in a second, expanded position according to another aspect of the disclosure.
Figure 2:
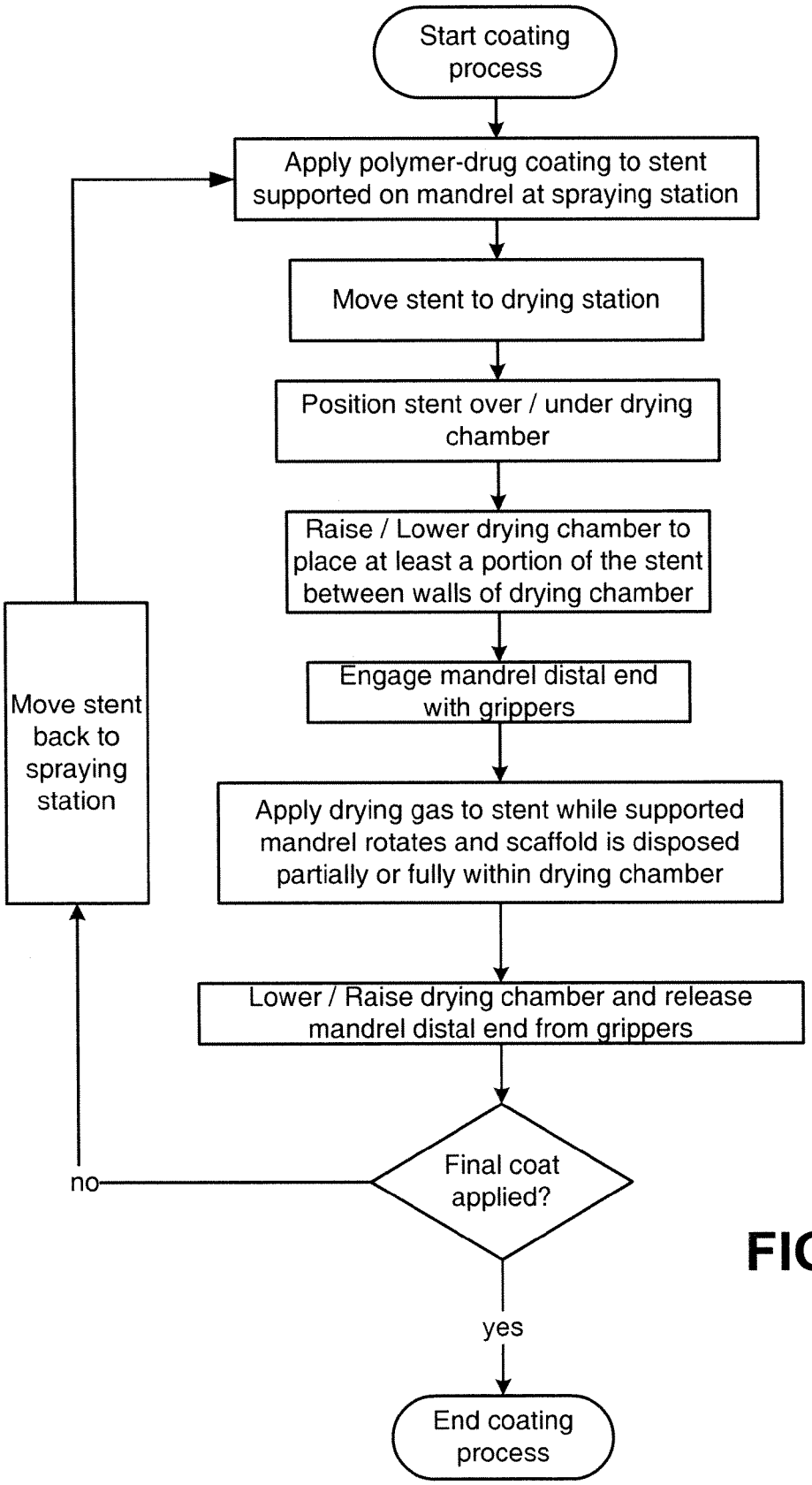
FIG. 2 summarizes a process for coating a stent including a spraying step and in-process drying step using the dryer assembly of FIG. 1.

FIGS. 1A-1B show side views of a telescoping dryer 10 (dryer 10) according to one aspect of the disclosure. FIG. 2 shows a flow process for applying, via a spray apparatus, a composition, i.e., drug-polymer coating dissolved in a solvent, to a stent including applying one or more coats of the sprayed composition followed by a drying step that may include using dryer 10. Accordingly, the dryer 10 may be included as a component to a stent coating apparatus. Such a stent coating apparatus implementing the process of FIG. 2 includes a sprayer, the dryer 10 and actuators for placing the stent between a spraying area or chamber and a drying area for performing a drying step, or solvent removal step, between each of several coatings of composition sprayed onto the stent. Examples of a stent coating apparatus that may adopt principles of the disclosure are described in U.S. patent application Ser. Nos. 12/497,133; 12/027,947 and 11/764,006. In these examples, the dryer(s) described therein may instead utilize a dryer according to the disclosure, as will be understood.

Referring, briefly, to side views of the dryer 10 as depicted in FIGS. 1A-1B, after one or more coatings are applied by a sprayer, the stent (supported on a mandrel 15) is moved into position over the dryer 10, as indicated in FIG. 1A. Mandrel grippers 60 then engage a distal end 15*a* of the mandrel 15 to account for any slight misalignments of the stent position over the dryer exit or mouth and stabilize the stent as it rotates and is impacted by gas exiting from the dryer plenum. A diffuser housing 30 telescopes or deploys from a base housing 20 (using a linear actuator mechanism 50) to place or enclose the stent within a shield 32, as indicated in FIG. 1B. After the drying step is complete, the diffuser housing 30 retracts back into the base housing 20, the grippers 60 are released from the mandrel end 15*a* and the stent moved back to the spraying station to apply the next coating. These steps of a stent coating process are summarized in FIG. 2.

FIGS. 1A and 1B show the stent positioned above the dryer 10. However, the stent may alternatively be located below the dryer 10. In such an arrangement, the shield 32 would be placed above the stent and the drying gas directed downward, rather than placed below the stent and directed upward, respectively, as depicted in these drawings.

The stent, supported on the mandrel 15, is rotated by a rotary mechanism (not shown) coupled to the mandrel 15 as the sprayer applies a drug-polymer dissolved in a solvent, e.g., DMAc or Acetone, to the surface of the stent. This rotary mechanism is also used to rotate the stent while it is disposed within the shield 32 to facilitate uniform removal of solvent about the circumference of the stent during drying. A mass of heated gas exits from the mouth of the dryer (at a base of the shield 32) to accelerate the evaporation, or boiling-off of solvent from the coated stent surface. In a preferred embodiment, this sprayer-dryer coating process is repeated until a final coating weight of drug-polymer and remaining solvent is measured. During each drying stage the gas is capable of producing a uniform heat transfer across the surface of stents or scaffolds, even for stents or scaffolds having lengths of 100 mm, 150 mm, and 200 mm.

A coating process according to FIG. 2 may be preprogrammed, or programmed on the fly to adjust parameters such as number of coats, or passes with the sprayer between drying steps, number of cycles of spraying and drying, etc. These and related parameters may be governed by the polymer-drug or solvent used, type of stent or medical device being coated, e.g., surface geometry. In particular embodiments the protocol for coating a stent may be governed by a predetermined number of coating cycles, i.e., spraying then drying, based on an analytically determined final coating weight, or by intermittent weighing of the stent to determine the number of cycles needed to arrive at the target coating weight.

Figure 3:
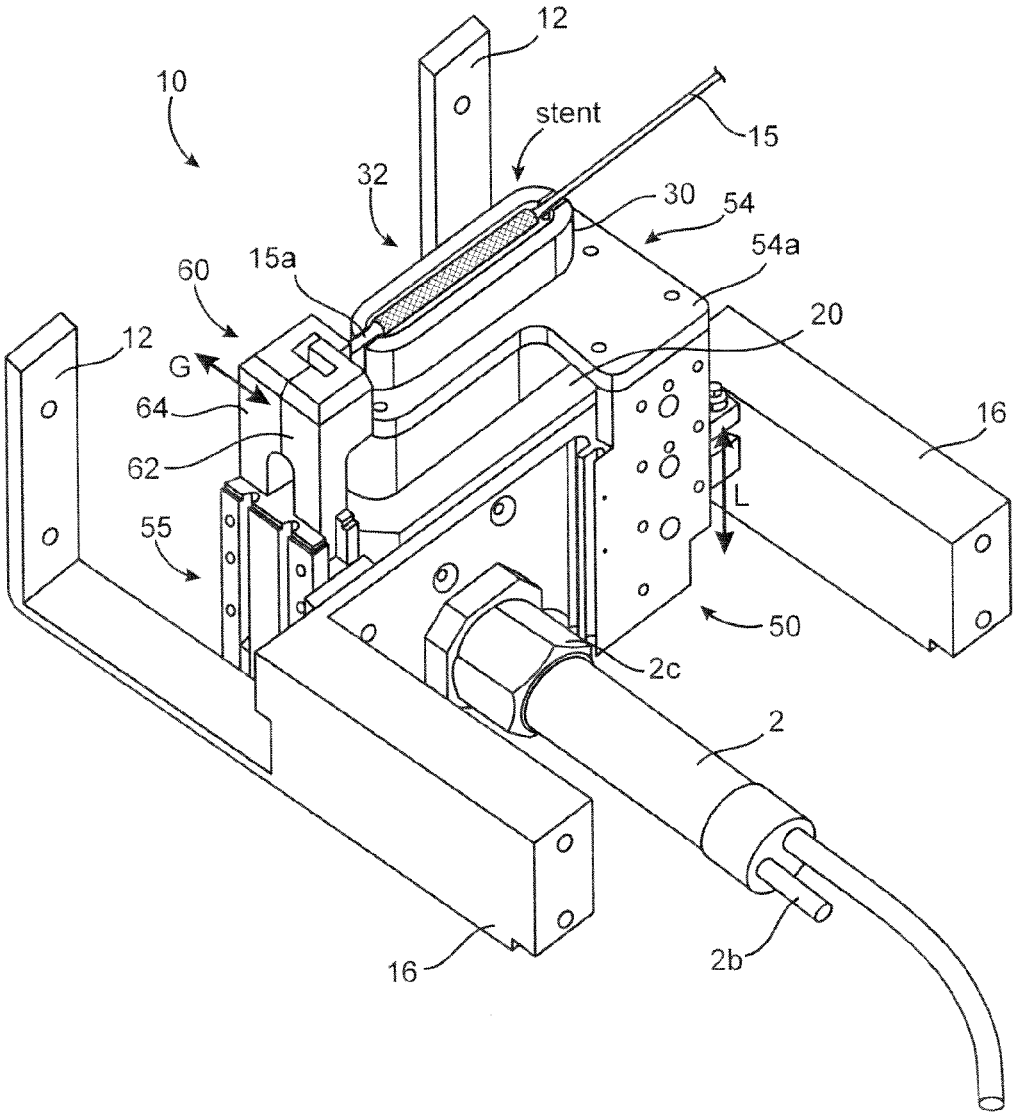
FIG. 3 is a rear perspective view of the dryer assembly.
Figure 4:
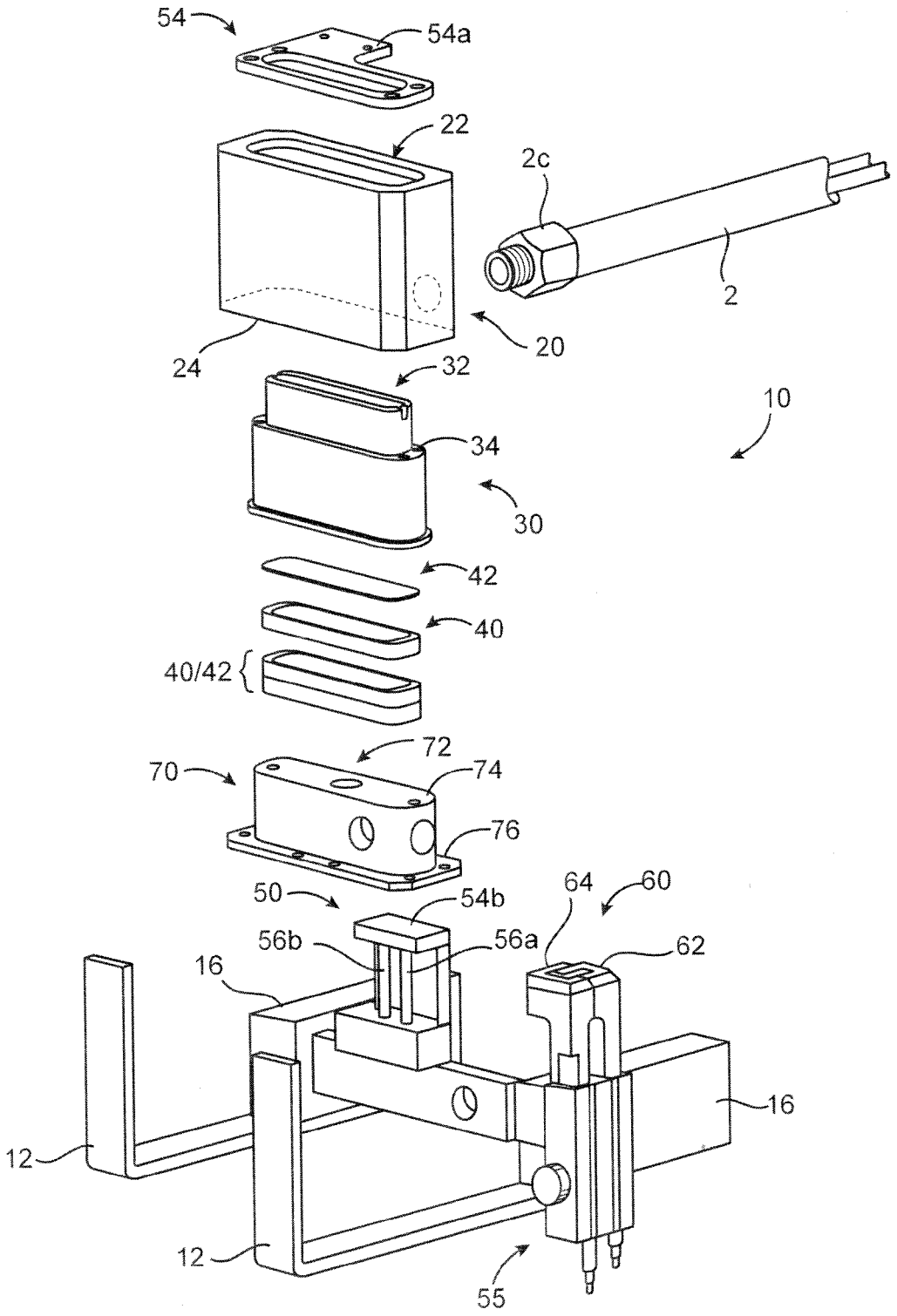
FIG. 4 is a front perspective, exploded assembly view of the dryer assembly showing component parts according to a preferred embodiment.

FIGS. 3 and 4 show an assembled rear perspective view and exploded front perspective assembly view, respectively, of the dryer 10. A mouth or exit of the dryer 10 is present at the base of the shield 32 and has dimensions the same as an opening of the shield 32; in other words, the walls forming the shield 32 are parallel to each other or the cross-sectional area of the entrance to the drying region surrounded by the shield 32 is the same as the cross-sectional area of the opening through which the stent passes when entering/exiting the drying region. A gas supply is connected to an entrance of the dryer 10 provided by the base housing 20. The drying gas, e.g., heated nitrogen or air, is supplied through a gas supply 2*b* connected to a heater assembly 2. The heater assembly 2 includes a tubular conduit with heating coils exposed to the gas stream as it travels towards the dryer entrance 9. The coils are connected to a power source via a power connection.

Figure 5:
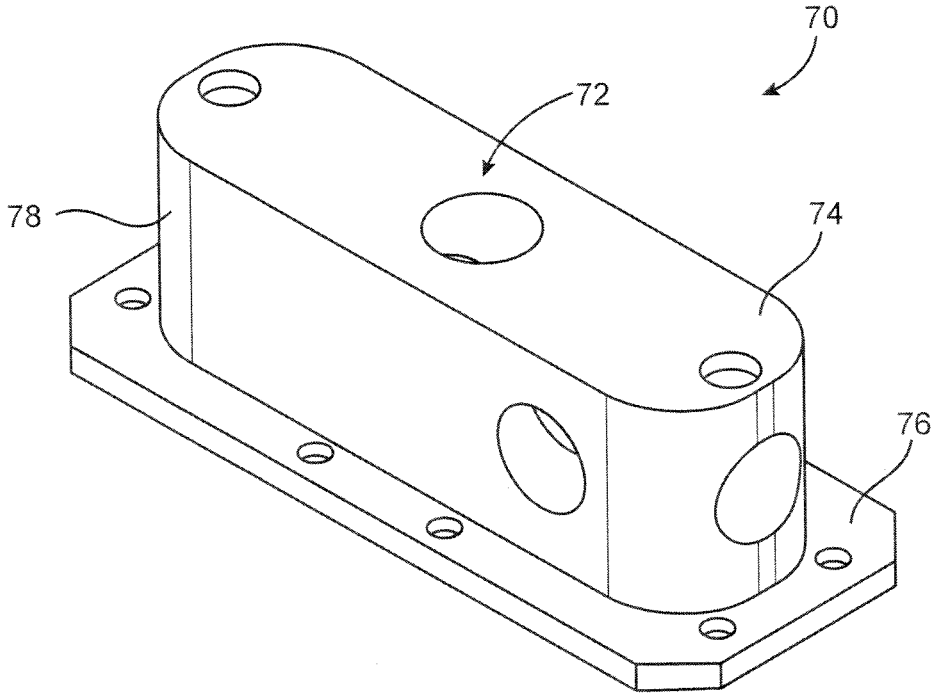
FIG. 5 is a perspective view of a base cap of the dryer assembly of FIG. 4.
Figure 6:
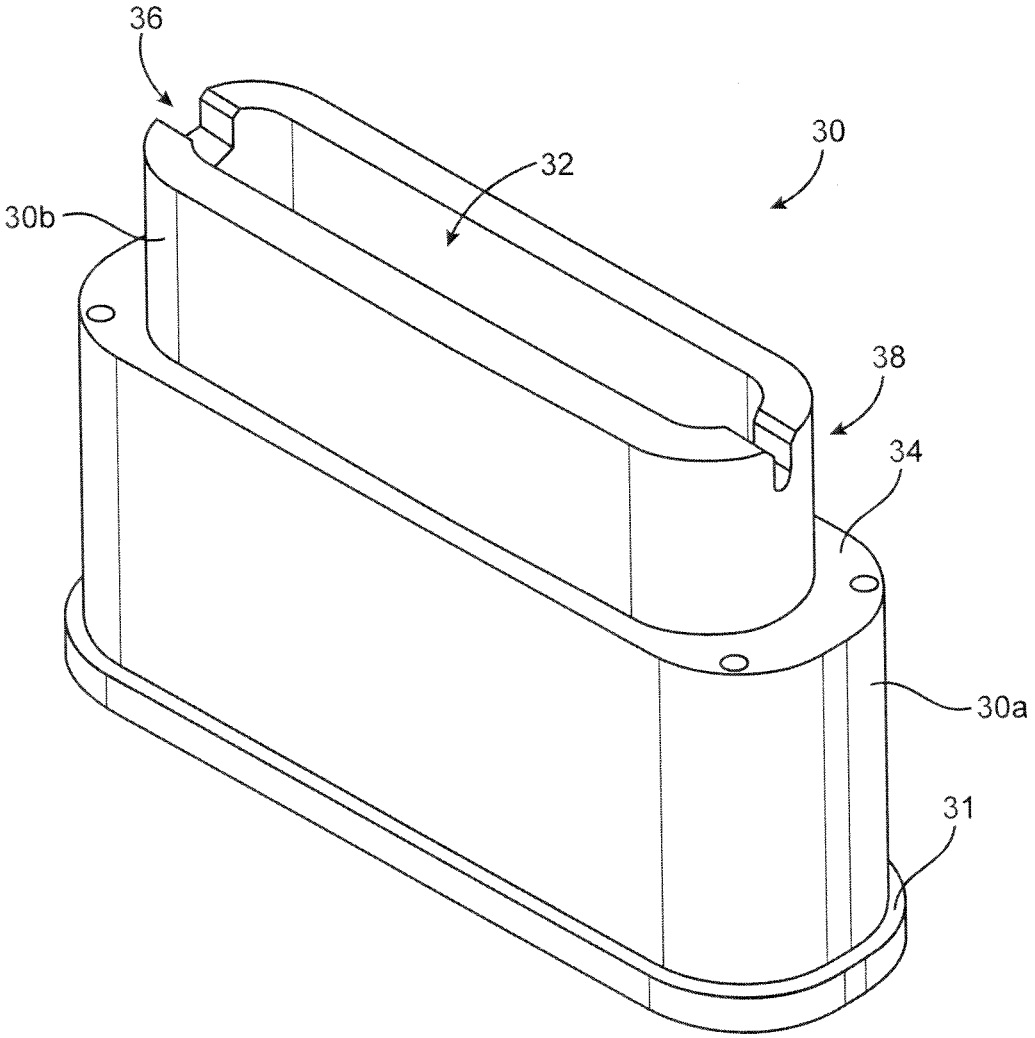
FIG. 6 is a perspective view of a diffuser housing of the dryer assembly of FIG. 4.

A plenum of the dryer 10 is formed by internal volumes of the base housing 20, the diffuser housing 30 and a base cap 70. Perspective views of the base cap 70 and diffuser housing 30 are illustrated in FIGS. 5 and 6, respectively. A hole in the dryer base housing 20 (hidden from view) is formed to co-align with a similar shaped hole in the base cap 70 (also hidden from view) to provide a passage for gas into the interior of the base cap 70. The hole or passage for gas through the base housing 20 includes a threading to sealingly engage a complimentary threaded fitting 2*c* of the heated gas supply. Gas entering through this passage passes directly into the interior of the base cap 70, exits through a hole 72 formed at the top of the base cap 70 then passes up through the diffuser housing 30. The base cap 70 and diffuser housing 30 are contained within the base housing 20 when fully assembled.

To account for any thermal energy loss for gas near the walls of the housings 20, 30 one or more mixing regions are provided within the diffuser housing 30 so that the gas entering the drying region surrounded by the shield 32 has a more uniform heat transfer across the length of the stent. Preferably three mixing regions are used for dryer 10. Each mixing region is formed by a diffuser screen 42 and spacer 40. Each screen and spacer are stacked on top of each other, as indicated in FIG. 4. From tests it was found that three spacers and screen assemblies were sufficient to cause no more than about a 1 degree Celsius temperature difference within the drying region during a drying step.

FIG. 4 indicates the order of assembly of the portions forming the plenum of the dryer 10, i.e., diffuser housing 30, base cap 70, base housing 20 and spacers and screens 40, 42. The three spacers and screens 40, 42 are placed inserted within the diffuser housing 30 and may be held in place by pins at the edge 31. The diffuser housing 30 is placed within the dryer base 20 through a bottom edge 24 thereof. The dryer housing 20 and diffuser housing 30 are then placed on the base cap 70 such that a lower edge 24 of the dryer housing 20 rests on a lower flange 76 of the base cap 70. The lower spacer 40*a* rests on an upper surface 74 of the base cap 70. The base housing 20 is press-fit onto the base cap 70 to provide a fluid-tight seal between the walls of the two structures. This assembled configuration of the dryer 10 is depicted in FIG. 1A.

As mentioned above, gas travels from the gas supply into the interior of the base cap 70, though the exit hole 72 and then through the diffuser housing 30. When the diffuser housing 30 is lifted up to position the stent within the drying region surrounded by the shield 32 (FIG. 1B), the spacer 40*a* lifts off the surface 74 of the base cap 70. To ensure gas passes directly from the base cap into the diffuser housing 30, a tight but slidable fit is formed between the interior walls of the housing 20 and a lower flange 31 of the diffuser housing 30. In essence, this fit maintains a desired gas pressure within the plenum while the dryer 10 is expanded (or housing 30 lifted) to receive the stent in the drying region, and while allowing the diffuser housing 30 to be moved up and down by the actuator 50 while the housing 20 and base cap 70 remain stationary (FIG. 1B). The travel upwards of the diffuser housing 30 within the base housing 20 is limited by the flange 31. After the diffuser housing 30 has traveled a sufficient distance (to place the stent within the drying region) the flange 31 abuts an upper surface of the opening 22 of the diffuser housing 20, thereby preventing further upward movement. To promote the seal between the interior walls of the housings 20, 30, therefore, the edge 31 slides against along the walls of the housing 20 as the diffuser housing 30 is being moved upwards and downwards within the housing 20 by the actuator 50. More generally, the sliding fit between these telescoping parts enables a plenum pressure to be achieved and maintained (no leaks) while the dryer 10 is retracted/shortened and expanded/lengthened.

As just alluded to, the aforementioned structure, i.e., housings 20, 30 and base cap 70, and mechanism 50 that form the plenum for the dryer 10 may be thought of as a telescoping dryer. Prior to the stent being positioned over the drying region, the diffuser housing 30 is retracted within the base housing 20 to provide clearance for the stent and mandrel 15 to be linearly displaced from the spray station to a position over the drying region. The dryer plenum is then essentially elongated or expanded to bring the stent into the drying region of the diffuser housing 30. Thus, a "telescoping dryer assembly" is intended to mean an arrangement of housings forming a plenum that slide inward and outward in overlapping fashion in a manner analogous to how a hand telescope slides inward and outward in an overlapping fashion, to thereby provide a variable length channel or internal passage for a pressurized fluid to pass through, i.e., a variable length plenum.

Figure 7A:
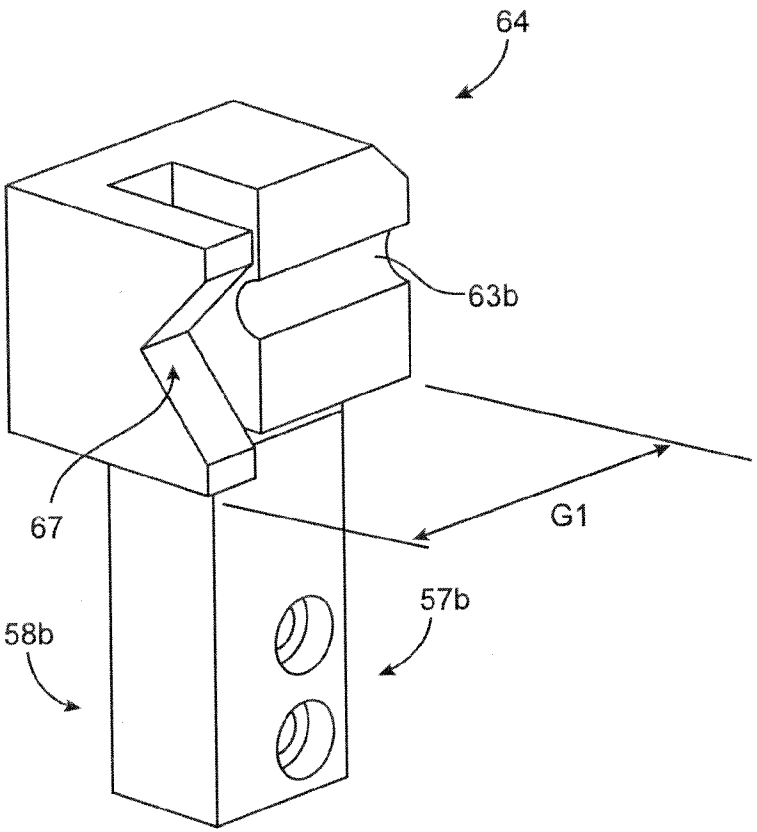
FIGS. 7A and 7B are perspective views of left and right grippers of a mandrel gripper of the dryer assembly of FIG. 4.
Figure 7B:
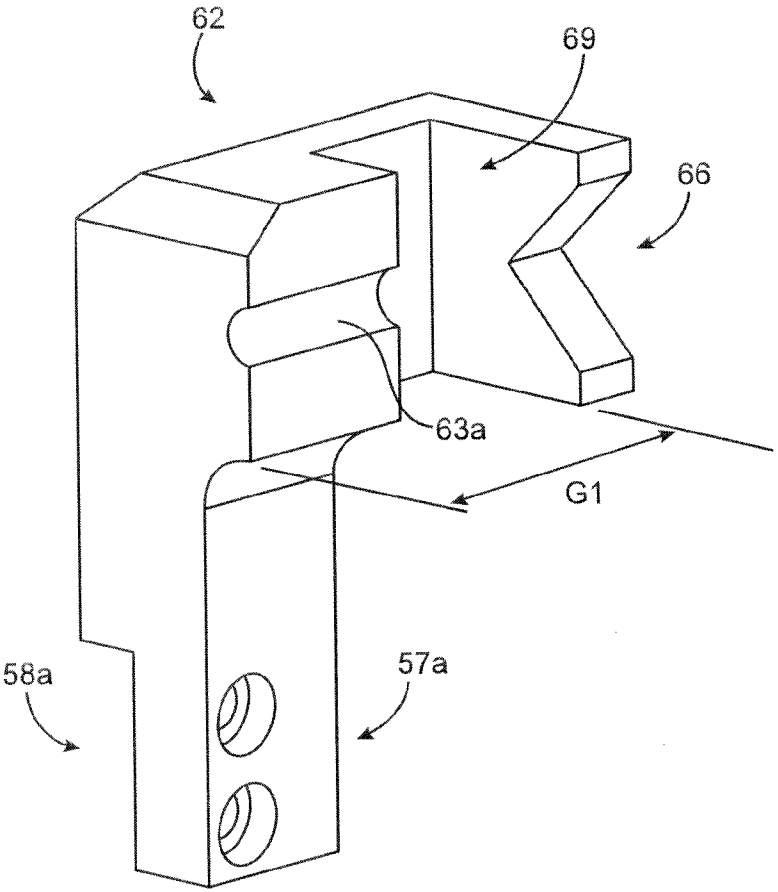

Referring to FIGS. 3 and 4, the dryer 10 components and actuating mechanisms 55 and 50 are secured to a plate 14, which is connected to a pair of blocks 16 and brackets 12. The actuating mechanism 55 is used to displace left and right grippers 62, 64 towards and away from each other to grip and release, respectively, the distal end 15*a* of the mandrel 15; this movement being indicated by the left and right arrows G in FIG. 3. A detailed view of each gripper 62, 64 is shown in FIGS. 7A-7B.

The actuating mechanism 50 (e.g., one or more hydraulic actuators, such as air cylinders, operated as part of a servomechanism pre-programmed or controlled by a computer processor to produce the desired movement in the housing 30 in accordance with a drying/spraying process as shown in FIG. 2) is used to raise and lower the diffuser housing 30; this movement indicated by the up and down arrows L in FIG. 3. A connecting plate 54 has a rim, which is placed over the diffusing housing and secured to a top ledge 34 of the diffuser housing 30, and a flange 54*a* that is secured to a platform 54*b* that is movable up and down by a pair of air cylinders 56*a*, 56*b*. Thus, the actuator causes the plate 54 to pull up on the housing 30 when the plenum is being extended or lengthened (FIGS. 1B and 3), and push down on the housing 30 when the plenum is being retracted or shortened (FIG. 1A). FIG. 3 shows the dryer 10 configuration with the housing 30 raised to position the stent within the drying region surrounded by the shield 32 and the gripper pair 62, 64 gripping the end 15*a* of the mandrel 15. This is also the configuration shown in FIG. 1B.

FIG. 5 shows a perspective view of the base cap 70, with the portions identified as previously described. As can be appreciated by comparing the contours of the base cap top surface 74 and the housing 30 (FIG. 6), the dryer 10 preferably has an elongate shape with rounded ends, just as the shield 32 is shaped to receive the stent or scaffold. The base cap 70 may be formed to have walls that are thicker than the housings 20, 30 (see FIG. 1A) to provide increased insulation capability. Since the gas enters here and is redirected 90 degrees to exit from hole 72, there is a greater heat loss possibility than after the gas exits through hole 72. As such, the walls are made thicker and preferably they are made from PEEK. As described earlier, a last step of the assembly for dryer 10 is to press fit the housing 20 (with diffuser housing 30 inside) onto the base cap 70. This last step essentially seals the dyer 10 and forms the interior space for the dryer plenum.

FIG. 6 shows a perspective view of the diffuser housing 30, with features of this structure as previously described. The shield 32 is elongate with rounded ends to receive the stent or scaffold therein. The shield 32 provides walls 30*b* that rise up from the ledge 34, which ledge 34 locates the exit opening from the plenum (the dryer mouth) into the drying region surrounded by the shield 32, thereby also reflecting a depth of the shield 32. Gas flowing near the stent and within the drying chamber 32 may exit from the plenum at a relatively low velocity which favorably limits the amount of regress or interference from ambient air. As mentioned earlier, by providing a shield and gas at a lower exit velocity which maintains its heat when exposed to the stent, there is an alternative to the dryer assemblies described in US20110059228 and US20110000427. The mouth of the dryer is located at the base of the shield. The opening provided for the stent is about the same size as the mouth size (not shown in the drawings).

FIGS. 7A and 7B show perspective views of grippers 62, 64, respectively. Each has arms 58*a*, 58*b* that form holes 57*a*, 57*a* at lower ends thereof to secure the grippers 62, 64 to the actuator mechanism 55 (FIG. 4) using bolts. At the head of the grippers 62, 64 are semicircular and complimentary slots 63*a*, 63*b* that are aligned to capture the distal end 15*a* of the mandrel 15 within a circular passage formed when the slots 63*a*, 63*b* are brought together by the actuator mechanism 55 (e.g., one or more hydraulic actuators, such as air cylinders, operated as part of a servomechanism pre-programmed or controlled by a computer processor to produce the desired movement in the grippers in accordance with a drying/spraying process as shown in FIG. 2). V-shaped sections 66, 67, aligned with slots 63*a*, 63*b*, function as guiding surfaces to urge the mandrel 15 into the semicircular slots 63*a*, 63*b* (see FIGS. 1B and 3). As can be appreciated by inspecting the spacing between the V-shaped section 66 and slot 63*a* of gripper 62, the closer spacing between the V-shaped section 67 and slot 63*b* of the gripper 64, the dimension G1 in FIGS. 7A-7B, and the interlocking manner in which the grippers engage the mandrel, as shown in FIG. 3, the V-shaped section 67 is disposed within the space 69 of the gripper 62 when the mandrel end 15*a* is engaged by the grippers 62, 64. When the stent is moved into position above the shield 32, the grippers 62, 64 come together. Any misalignment of the mandrel end 15*a* is adjusted by the V-shaped sections engaging the mandrel end 15*a* and urging it towards alignment with the slots 63*a*, 63*b*. When the grippers 62, 64 are moved into contact with each other, the mandrel end 15*a* is held in place within the circular passage formed by the slots 63*a*, 63*b*. This ensures that the stent is being positioned properly within the shield 32 and held in position when the drying gas is passed over the stent. The mandrel end 15*a* may rotate while it is disposed within the circular passage formed by the slots 63*a*, 63*b*.

The walls 30*b* forming the shield 32 include a first notch 36 disposed at one rounded end, and a second notch 38 disposed at a second or opposed rounded end. These notches 36, 38 are used to allow the mandrel that the stent sits on to lower the stent to within the shield 32 during the drying. When the gas exits, even at a low velocity the stent will oscillate since it rotates which presents a varying surface area to the gas exiting (in addition to the non-laminar or transient flow in and around the stent). The problem of oscillations is especially noted for stents that are 40 mm and longer, e.g., stents (or scaffolds) intended for the superficial femoral artery. To meet these needs the dryer 10 includes a support for the mandrel 15 distal end 15 *a*, i.e., mandrel grippers 60, in addition to the notches 36, 38. With the additional support provided by grippers 60 the stent becomes effectively fixed-supported at the mandrel distal end 15*a* when disposed over the dryer mouth (exit of the plenum), yet is still capable of being rotated about the mandrel axis by a rotary mechanism coupled to the mandrel. This support may be achieved without interference with drying and prevents contact between the stent/scaffold and the walls 30*b* or mandrel 15 as the gas passes over the stent/scaffold.

The stent is mounted onto the mandrel 15 prior to the start of the stent coating process (FIG. 2). The mandrel 15 controls the stent position during drying and spraying. The mandrel 15 generally maintains axial alignment of the stent, and causes the stent to rotate at generally the same rate as the mandrel 15, which has a proximal end that fits into a chuck. The chuck delivers a torque to the mandrel 15. The slots 36 and 38 provide a sufficient clearance to allow the mandrel 15 to rotate. The mated grooves 63*a*, 63*b* (FIGS. 7A-7B) also provide this clearance for rotation. Some heating gas will escape through the slots 36 and 38.

Figure 8:
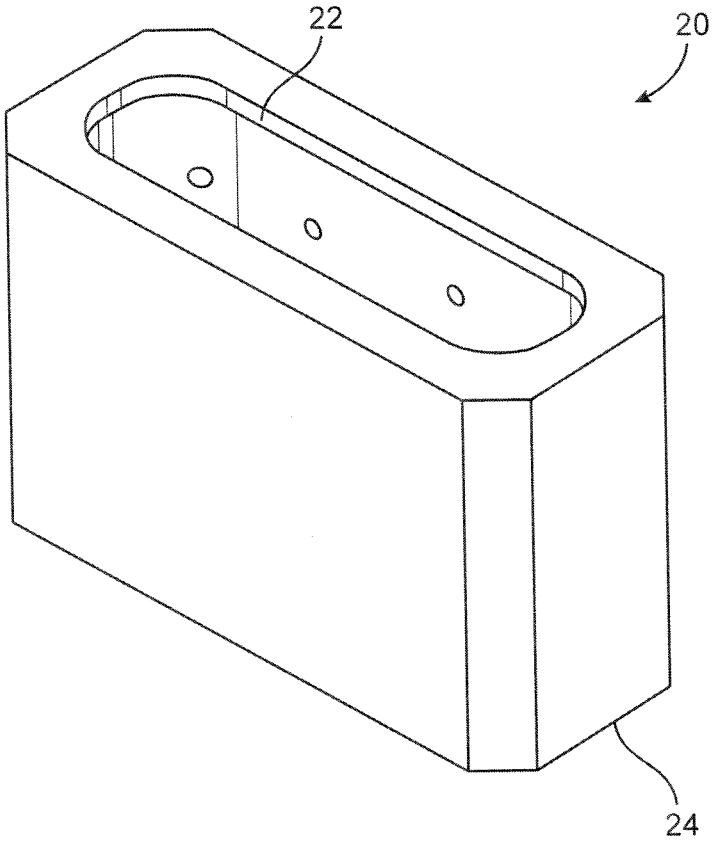
FIG. 8 is a perspective view of a base housing of the dryer assembly of FIG. 4.

FIG. 8 shows a perspective view of the base housing 20, with the portions identified as previously described. As mentioned earlier, the base housing 20 includes a threaded fitting (hidden from view) that receives the fitting for the gas supply. The diffuser housing 30 and spacers/screens 40, 42 are received in the base housing 20. The walls forming the shield 32 extend out from the opening 22 of the base housing 20 (see FIG. 1B).

For the drying systems described in US20110059228 and US20110000427 there is preferably an oven step for removing residual solvent from the stent or scaffold. In an additional aspect of disclosure, the oven step may be skipped as tests show that the dryer 10 and process as shown and described may remove solvent at a sufficient rate during the process of FIG. 2 to obviate an oven step. This is desirable as it reduces manufacturing time for the medical device.

Twelve as-coated samples were collected to assess efficiency of the dryer 10 with and without a later oven step. Those samples were processed using inter pass dry temperature at 50 C. Those samples were divided into two groups—Group A and Group B. The six group A samples were kept in a tightly sealed vial and in the refrigerator prior to residual solvent testing, and while the six group B samples proceeded with an additional oven dry at 50 C for 30 minutes immediately after the final coating step, then kept in the vial.

The residual acetone data for the two groups are listed in the TABLE 1. The data shows that there is not much different between the average of the residual acetone level between the two groups (between 1 to 2 micrograms). This is because the actual amount of a residual solvent present in a coated stent can vary within a few micrograms of a measured amount, which is what TABLE 1 shows. Moreover, in some applications up to 5 μg of residual solvent remaining in the coating is considered acceptable. Accordingly, the test suggests there may be no need to have an oven bake step when using a dryer constructed in accordance with dryer 10.

TABLE 1 residual acetone levels for Groups A vs. Group B (six 12 mm stents)

| | Residual acetone μg/stent (12 mm) | |
|---|---|---|
| Stent # | Group A 100165795 without oven step | Group B 100165796 with Oven step |
| 1 | 1.17 | 1.66 |
| 2 | 1.06 | 1.29 |
| 3 | 1.06 | 1.48 |
| 4 | 0.88 | 1.37 |
| 5 | 5.20* (outlier) | 1.04 |
| 6 | 1.14 | 1.04 |
| Average | 1.0 (does not include the outlier) or 1.8 (includes the outlier) | 1.3 |

A gas flow rate through the heater assembly 2 in FIG. 1 may be monitored/controlled by a commercially available mass flow regulator (not shown). For example, such a mass flow regulator may be used to operate an adjustable valve coupling the gas supply line 2*b* to a gas source to produce the desired flow rate. One example of a suitable mass flow regulator is the Aalborg GFCS series programmable mass flow regulator. A use of a mass flow regulator and related control system suitable for use with aspects of the disclosure is described in U.S. application Ser. No. 12/540,302.

During a coating process, the dryer is not in use when the stent is being coated. If the dryer is shut down or the flow rate reduced the temperature of the gas at the entrance to the plenum 10 of the dryer 1 will decrease. If the stent is moved into position above the nozzle mouth for drying and the valve opened to increase the flow rate, there will be a period of transient flow. It is desirable to avoid a period of solvent removal by transient gas flow, since the rate or amount of solvent removal by transient flow can be difficult to predict. It is preferred, therefore, that the stent is dried only during steady state flow conditions.

If gas flow at the dryer is instead maintained at a constant rate, then the temperature may be maintained. However, this wastes gas resources. It would be desirable if the gas flow rate could be reduced when the dryer is not in use while holding the gas temperature at a constant value.

Figure 9:
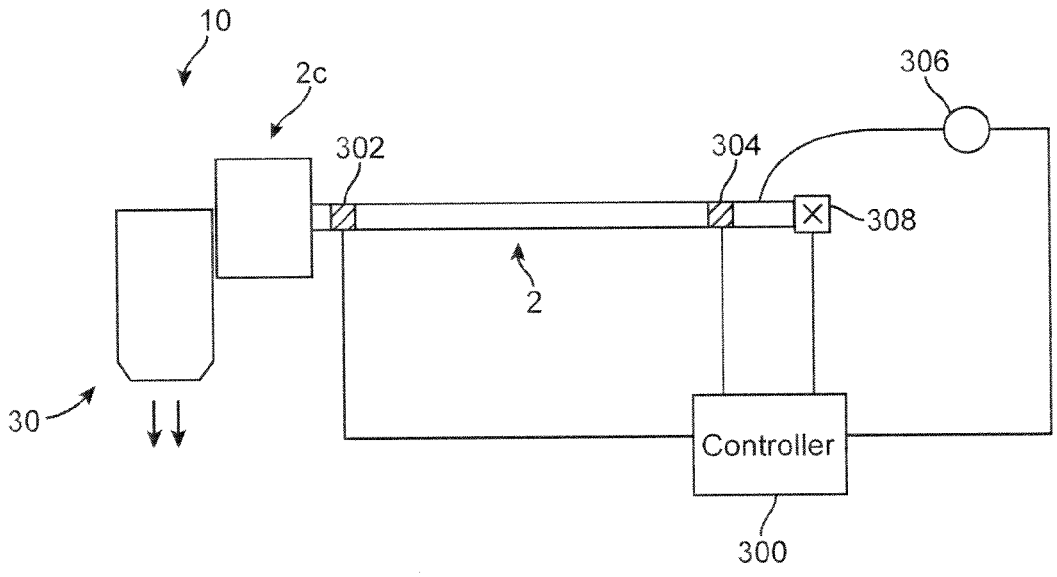
FIG. 9 is a schematic of a control system that may be used with the dryer assembly to minimize transient flow or wait time and conserve dryer resources while a coating is being applied to a stent.

To meet this need, a closed loop control is preferably implemented with a stent dryer system according to the disclosure, so that the gas temperature may be maintained at variable flow rates. Referring to FIG. 9, a schematic of this closed-loop control is illustrated. A controller 300 continuously receives input temperatures at the entrance of the plenum from a thermocouple 302 and the gas flow rate upstream of the plenum entrance from a flow sensor 304. The controller 300 may be programmed to reduce the gas flow rate when the dryer is not in use, and increase the gas flow rate when the stent is ready to be moved into position above the dryer mouth.

As the flow rate is adjusted by opening/closing the adjustable valve 308, the controller senses a change in temperature from input received at the thermocouple 302, at which point it will increase/decrease the power delivered to the heating coils by affecting control 306 for power so that the temperature remains constant, regardless of the actual flow rate. Thus, according to this aspect of the disclosure, a dryer system may be operated at variable flow rates during a coating process while maintaining a substantially steady state gas flow during the drying stage, or a minimal period of transient flow conditions until a steady state condition is reached. This improves/maintains the predictability of solvent removal during drying, minimizes down time and allows gas resources to be conserved. The coated stent is almost immediately subject to the drying step and dried in a manner that allows the improved prediction of solvent removal. As discussed earlier, this is a critical step in the process of producing a predictable release rate for a drug-eluting stent and accurate assessment of whether the desired drug-polymer coating weight has been reached.

After, or just prior to completion of an application of coating composition on the stent, the controller 300 increases the gas flow temperature to the drying gas flow rate. While the gas flow is being increased, the controller 300 monitors the temperature at the plenum entrance 2*c* by input received from the thermocouple 302 and the power increased to the heating coils as necessary to maintain the temperature of the exiting gas flow. Once the gas flow has reached the operating flow rate and temperature, the stent is moved into position above the shield 32 and the housing 30 raised. The stent is rotated. After drying is complete, the gas flow is again returned to the idle state and the power to the heating coils decreased as necessary to maintain the same gas flow temperature (based on input received from the thermocouple 302) at/near location 2*c*. The process repeats until the desired coating weight is obtained.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in claims should not be construed to limit the invention to the specific embodiments disclosed in the specification. Rather, the scope of the invention is to be determined entirely by claims, which are to be construed in accordance with established doctrines of claim interpretation.

What is claimed is:

1. A method for applying a composition to a stent, comprising the steps of:

spraying the composition on the stent; and drying the stent, including the steps of moving a drying region towards the stent or the stent towards the drying region to place the stent within the drying region, the drying region being surrounded by a shield having at one end an opening and, at an opposite end, a mouth of a dryer nozzle directly over or under the opening, wherein the stent or drying region is moved towards the other when the stent is over or under the mouth, and the stent passes through the opening when placed in the drying region, drying the stent using a heated gas that passes through the nozzle and exits from the mouth at a gas velocity, passes over the stent while the stent occupies the drying region, and exits the drying region through the opening, wherein gas pressure produced by the heated gas prevents air external of the shield from being drawn into the drying region from the opening, and after drying the stent, moving the drying region away from the stent or the stent away from the drying region.

2. The method of claim 1, wherein the moving step includes the shield being raised or lowered when a mandrel supporting the stent is over or under, respectively, the shield to place the stent into the drying region.

3. The method of claim 2, further including the step of disposing a proximal end and a distal end of the mandrel within alignment grooves of the shield, and rotating the mandrel when the drying gas is applied and the ends sit in the grooves.

4. The method of claim 1, wherein the stent is supported on a mandrel, the drying step further including an actuator gripping a distal end of the mandrel when the stent is over or under the shield.

5. The method of claim 1, wherein the moving step includes the step of expanding a plenum of the dryer to place the stent in the drying region.

6. The method of claim 1, wherein a size of the opening is the same as a size of the mouth.

7. The method of claim 6, wherein a housing of the nozzle comprises the shield.

8. A method for applying a composition to a stent, comprising the steps of:

spraying the composition on the stent;

moving the stent below or above a drying assembly, the drying assembly comprising a dryer nozzle and a shield, wherein the nozzle comprises a mouth and internal diffusers, the shield has a depth, and comprises a base and an opening separated from the base by the depth, the opening is located directly below or above the base, and the base is coupled to the mouth;

placing the stent within a drying region surrounded by the shield, wherein the stent passes through the opening when entering the drying region; and while the shield surrounds the stent, drying the stent using a heated gas that exits from the dryer mouth, enters the drying region, and exits the drying region through the opening.

9. The method of claim 8, further including supporting the stent above or below the assembly before the shield surrounds the stent.

10. A method for applying a composition to a stent, comprising the steps of:

spraying the composition on the stent;

moving the stent below or above a drying assembly including a shield coupled to a mouth of a dryer; and while the shield surrounds the stent, drying the stent using a heated gas that exits from the dryer mouth wherein the moving step further includes increasing a length of a plenum of the drying assembly so as to surround the stent with the shield.

11. The method of claim 10, wherein the drying assembly is a telescoping drying assembly.

12. The method of claim 8, wherein a steady state gas flow rate is applied to the dryer when the composition is being sprayed on the stent such that a rate of solvent removal is substantially constant during when the stent is above or below the drying assembly including monitoring a gas temperature and if the gas temperature deviates from the drying temperature increasing or decreasing the gas temperature to maintain the steady state value.

13. The method of claim 8, wherein gas passing through the nozzle is mixed by forcing the gas through the internal diffusers in order to produce a uniform property of the heated gas exiting from the nozzle mouth, wherein the uniform property is a gas temperature that varies over a length of the stent by less than 1 degree C.

14. The method of claim 11, further including the step of retracting the telescoping dryer assembly, followed by spraying the composition on the stent a second time.

15. The method of claim 10, wherein the shield has a first and second notch for receiving respective first and second portions of a mandrel located on opposite sides of the stent.

16. The method of claim 15, wherein the stent and mandrel are rotating when the gas is applied.

17. The method of claim 1, wherein the shield has a first and second notch for receiving respective first and second portions of a mandrel located on opposite sides of the stent.

18. The method of claim 1, wherein the gas passing through the nozzle is mixed by forcing the gas through internal diffusers in order to produce a uniform property of the heated gas exiting from the nozzle mouth, wherein the uniform property is a gas temperature that varies over a length of the stent by less than 1 degree C.

* * * * *